US011428514B2

(12) United States Patent
Randall et al.

(10) Patent No.: US 11,428,514 B2
(45) Date of Patent: Aug. 30, 2022

(54) SYSTEM AND METHOD FOR ARCHERY BROADHEAD

(71) Applicants: Jaden Randall, Smithville, TX (US); Sean Moyer, Smithville, TX (US)

(72) Inventors: Jaden Randall, Smithville, TX (US); Sean Moyer, Smithville, TX (US)

( * ) Notice: Subject to any disclaimer, the term of this patent is extended or adjusted under 35 U.S.C. 154(b) by 0 days.

(21) Appl. No.: 17/494,698

(22) Filed: Oct. 5, 2021

(65) Prior Publication Data

US 2022/0026185 A1 Jan. 27, 2022

Related U.S. Application Data

(63) Continuation of application No. 17/025,961, filed on Sep. 18, 2020, now Pat. No. 11,137,236.

(60) Provisional application No. 62/901,913, filed on Sep. 18, 2019.

(51) Int. Cl.

| | |
|---|---|
| ***F42B 6/04*** | (2006.01) |
| ***F42B 6/08*** | (2006.01) |
| ***F42B 12/38*** | (2006.01) |

(52) U.S. Cl.

CPC ..... *F42B 6/08* (2013.01); *F42B 12/385* (2013.01)

(58) Field of Classification Search

CPC ..... F42B 6/04; F42B 6/08; F42B 12/385
See application file for complete search history.

(56) References Cited

U.S. PATENT DOCUMENTS

| | | | | | |
|---|---|---|---|---|---|
| 2,829,894 | A * | 4/1958 | Henkel | F42B 6/08 | 473/584 |
| 2,909,372 | A * | 10/1959 | Neri | F42B 6/08 | 473/584 |
| 3,138,383 | A * | 6/1964 | McKinzie | F42B 6/08 | 43/6 |
| 4,410,184 | A * | 10/1983 | Anderson | F42B 6/08 | 473/584 |
| 4,976,442 | A * | 12/1990 | Treadway | F42B 12/385 | 473/578 |
| 5,188,373 | A * | 2/1993 | Ferguson | F42B 12/385 | 473/578 |
| 6,856,250 | B2 * | 2/2005 | Hilliard | G01S 13/758 | 340/573.2 |
| 7,232,389 | B2 * | 6/2007 | Monteleone | F42B 12/40 | 473/578 |
| 8,192,309 | B1 * | 6/2012 | Roberts | F42B 12/385 | 473/578 |
| 9,075,124 | B2 * | 7/2015 | Zusman | G01S 3/40 | |
| 9,335,135 | B2 * | 5/2016 | Powell | G06F 3/00 | |
| 9,341,450 | B1 * | 5/2016 | Lin | F42B 6/08 | |
| 9,658,041 | B2 * | 5/2017 | Powell | H04N 13/144 | |
| 10,871,357 | B2 * | 12/2020 | Ferguson | F42B 12/385 | |
| 2018/0142996 | A1 * | 5/2018 | Wetzler | F42B 12/385 | |

* cited by examiner

*Primary Examiner* — John A Ricci
(74) *Attorney, Agent, or Firm* — Bell Nunnally & Martin LLP

(57) ABSTRACT

A broadhead is provided that is versatile, reusable, and revolutionary in the hunting industry. Various embodiments of the broadhead provide interchangeable technology to accommodate multiple hunting situations by being able to switch between fixed and expandable blades. In some embodiments, the broadhead is provided with the ability to accept a variety of different types of tracking devices in conjunction with a removable barb to allow the use of innovative trackable technology.

15 Claims, 8 Drawing Sheets

SYSTEM AND METHOD FOR ARCHERY BROADHEAD

RELATED APPLICATIONS

This application is a continuation of U.S. Non-Provisional application Ser. No. 17/025,961, entitled "System and Method for Archery Broadhead," filed on Sep. 18, 2020, which claims the benefit under 35 U.S.C. § 119(e) to U.S. Provisional Application Ser. No. 62/901,913, entitled "SEO BROADHEAD," filed on Sep. 18, 2019, the disclosures of which are each hereby incorporated by reference in their entirety.

BACKGROUND

Technical Field

The present invention relates to an archery broadhead and more particularly to an improved archery broadhead having a detachable element.

Background

Arrows have long been used for war, hunting and competitive sports. A conventional arrow has a shaft, a nock at one end that receives the bow string, an arrowhead or point that attaches to the opposite end, and fletching. The fletching is glued to the shaft near the nock end, and help to stabilize the arrow in flight, as it rotates. Arrowheads generally have a pointed forward end, and an opposite threaded shaft end that attaches the arrowhead to the arrow shaft. Arrowheads are also attached to the forward end of arrow shafts by gluing and other methods. Arrowheads come in a variety of different sizes and configurations depending on their intended use. For example, there are specifically designed arrowheads for competitive target shooting, shooting fish, hunting birds or small game animals, and for hunting big game animals.

Arrowheads for hunting are generally known as broadheads. Broadheads are used with all types of archery equipment to hunt a variety of game. Broadheads make the first contact with the animal and are responsible for creating a fatal wound channel in order to harvest the animal. Typically, the broadhead screws into the end of a shaft of an arrow and is a sharp object made up of either fixed or expandable blades. The most common type of arrowhead used in hunting is the fixed-blade arrowhead, which has a pointed tip end used for penetrating, and fixed blades or non-pivotal blades that each have a razor sharp edge for cutting. Conventional fixed-blade arrowheads blades are held in a fixed position on the arrowhead, and most such blades are replaceable. For example, U.S. Pat. No. 7,708,659, which is incorporated herein by reference, describes a Fixed Blade Broadhead having replaceable blades that attach to the arrowhead body in longitudinal grooves. The tip of the arrowhead may be separably attachable to the arrowhead body or may be integral with it. Fixed blades have a set cutting diameter and do not move upon impact.

Another popular type of arrowhead for hunting is the blade-opening arrowhead. Blade-opening arrowheads, like conventional fixed-blade arrowheads, generally have an elongated arrowhead body, a tip end, and a threaded opposite end. The blades of blade-opening arrowheads have an attachment end which attaches the blades to the arrowhead body by a pivot pin, so that the blades can pivot or rotate in a plane between a first retracted position and a second open position. Blade-opening arrowheads also come in a variety of different types and styles. The blades of the most common type of blade-opening arrowheads, when in the retracted position have a leading blade end positioned near the tip of the arrowhead that protrudes outward from the arrowhead body. For example, U.S. Pat. No. 8,469,842, which is incorporated herein by reference, describes an expandable broadhead having protrusions that cause the blades to rotate away from the arrowhead body when penetrating an animal. The blades of blade-opening arrowheads are also received in blade slots, which are machined or formed into the side of the arrowhead body. In the past, if a hunter wanted to switch between a fixed blade broadhead and an expandable blade broadhead, the hunter had to remove the entire broadhead and replace it with a different broadhead.

One problem that archery hunters face occurs after an animal has been shot. Almost every broadhead on the market today is designed to fatally injure the target animal with the correct shot placement. Archery hunting offers hunters with more challenges and thus makes hunters susceptible to human error. Practicing and preparing helps archery hunters to decrease the chance of human error but human error occurs more often than one would like to admit. Every year, numerous animals are injured or affected by hunters making a poor shot on them. Many animals are either not recovered or they get recovered after the meat has expired. This problem is common from amateur hunters all the way up to the professional hunters. Arrows having tracking devices have been developed to allow archery hunters to track, locate, and recover animals once a shot has been made. For example, one such prior art design is the miniature locator device described in U.S. Pat. No. 8,393,982, which is hereby incorporated by reference. This device is not a broadhead. Rather, this device is an additional piece that screws into the shaft of the arrow and allows a broadhead to be attached to it. This not only increases the weight of the arrow, but also the overall length of the arrow. This device utilizes a barb at the front of the tracking device, which allows the device to be tagged on the outside of the animal. However, these tracking devices are often cumbersome, adding weight and length to an arrow. Other similar tracking devices typically can only be used with a single type of arrow or broadhead. For example, U.S. Pat. No. 8,529,383, which is hereby incorporated by reference, describes a tracking unit for inclusion within an arrow . In archery hunting, weight, speed, aerodynamics, and cost are often limiting factors for hunters wanting to use a tracking device.

Thus there is a need for an innovative technology that can provide archery hunters flexibility in the arrows and broadheads they use.

SUMMARY OF THE INVENTION

The present invention comprises a novel broadhead design. In various embodiments, a singular broadhead is provided having the capability to interchange both expandable and fixed blades into one ferrule. The benefits of this technology include, but are not limited to, giving the user the ability to purchase one set of broadheads and have the capability to choose which blade configuration the user would like for each particular and unique hunting situation. Allowing the blades to be interchanged to either system on the fly, allows the user to be able to adapt to any situation without having to buy two different types of broadheads. In some embodiments, a broadhead is provided that allows space for a detachable barb which is attached to a tracking device that releases upon the force of impact and attaches to the animal without significantly hindering the functioning of the broadhead.

In various embodiments, a new design of a broadhead is provided that uses one singular semi-hollow ferrule that may accept two different types of blade systems. The first blade system may be a mechanical blade system and the second may be a fixed blade system. The blade systems can be interchanged by the use of, for example, a pin and/or screw. In some embodiments, the attachment mechanism may comprise a single pin and a single screw. Various embodiments include a novel way the mechanical blades fit and work inside the ferrule of the broadhead such that the blades may be removed and replaced with fixed blades that accommodate the same or similar space as the mechanical blades. In various embodiments, the broadhead may include a semi-hollow ferrule to accept a tracking device via a detachable barb mechanism, allowing the deliverance of a tracking device while still employing a workable broadhead in either fixed or expandable blade configuration.

In various embodiments, a broadhead is provided that allows a tracking device to be stored within the broadhead ferrule and allows the tracking device to be fully penetrated into the animal upon impact. In some embodiments, this may be done by the rear placement of the barb on the tracking device, allowing the tracking device to enter the wound channel of the animal while the barb snags and holds onto the hide of the animal. In various embodiments, the broadhead contains the tracking device and, thus, the two are considered as one functional piece that does not change the overall length of the arrow and does not add significantly to the weight of the arrow.

In various embodiments, a broadhead is provided that provides the above-mentioned benefits while also providing similar features to traditional broadheads. For example, many hunters prefer expandable blades for deer hunting and fixed blades for animals with tougher hides, such as wild hogs. The interchangeable blade system gives hunters the capability to adapt to any hunting situation without having to purchase different types of broadheads. Hunters across the country, especially in the southern region of the U.S., come into contact with many different species of animals on a single hunt. By allowing the user to change the blade system from expandable to fixed will help the user to select the version of the correct and preferred choice of blade system that each situation calls for. Another added benefit of interchangeable blade systems is the ability for the user to purchase a set quantity of ferrules with the ability to incorporate tracking devices along with both fixed and expandable blades, allowing multiple customizations by the end user.

The above summary of the invention is not intended to represent each embodiment or every aspect of the present invention. Particular embodiments may include one, some, or none of the listed advantages.

BRIEF DESCRIPTION OF THE DRAWINGS

A more complete understanding of the method and apparatus of the present invention may be obtained by reference to the following Detailed Description when taken in conjunction with the accompanying Drawings wherein.

DETAILED DESCRIPTION

FIGS. 1-7 show different aspects of various embodiments of a broadhead 100 according to the present invention. As used throughout this specification and in the claims, the term expandable broadhead is intended to relate to and include any apparatus and/or method in which one or more blades are configured to move between a retracted position and an expanded position with respect to a ferrule. In various embodiments, as the one or more blades move from a relatively retracted position to a relatively expanded position, each blade pivots or moves radially outward from the ferrule. The various features and advantages of the systems and methods described herein will become more apparent from the following description of the embodiments illustrated in the figures. These embodiments are intended to illustrate the principles of this disclosure, and this disclosure should not be limited to merely the illustrated examples. The features of the illustrated embodiments can be modified, combined, removed, and/or substituted as will be apparent to those of ordinary skill in the art upon consideration of the principles disclosed herein.

Figure 1:
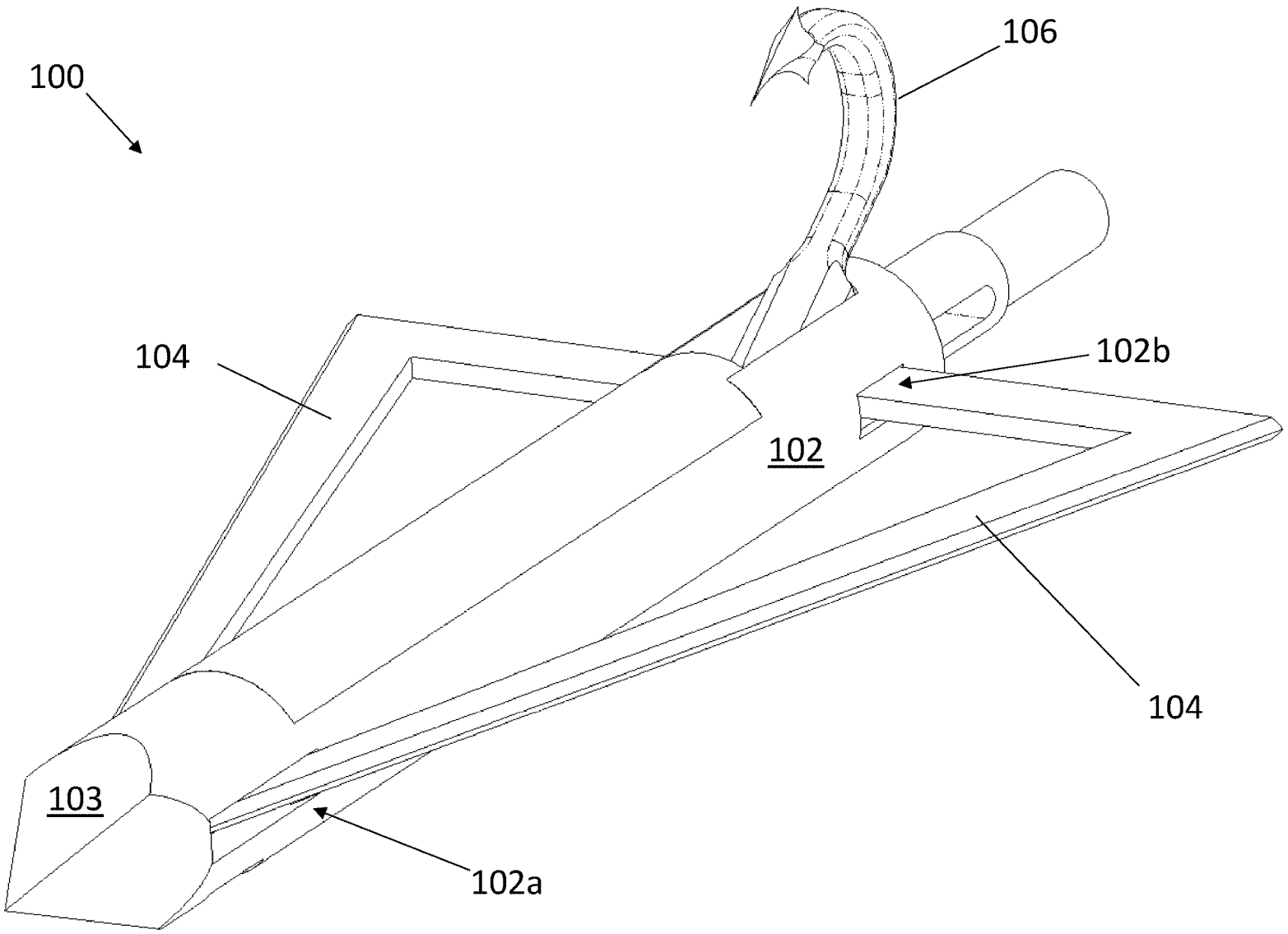
FIG. 1 illustrates a broadhead with fixed blades and a barb according to an embodiment of the present invention.
Figure 2:
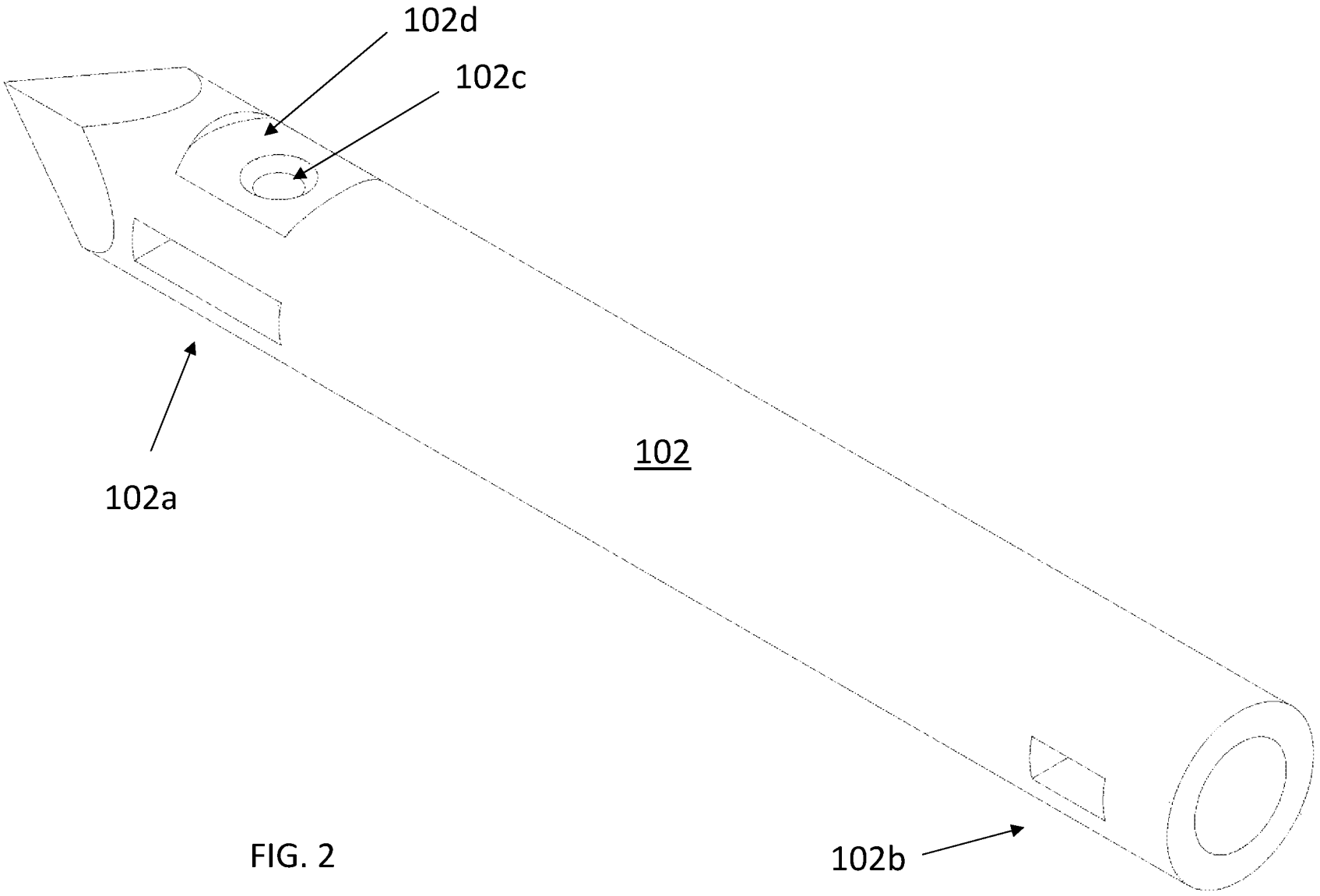
FIG. 2 is an embodiment of a ferrule of the broadhead of FIG. 1.

Referring now to FIGS. 1-4, various aspects of an embodiment of a broadhead 100 having fixed blades 104 are shown. In this exemplary embodiment, the broadhead 100 comprises a ferrule 102 and two fixed blades 104 removably secured to the ferrule 102. In some embodiments, the ferrule 102 may be generally cylindrical with an approximately 8 mm diameter and may incorporate a chamfered nose 103 to create a piercing tip. In some embodiments, the nose 103 may be removable secured to the ferrule 102. In other embodiments, the ferrule 102 may be larger than 8 mm or smaller than 8 mm and may be other, non-cylindrical shapes, depending on desired aerodynamics and other parameters. As can be seen in FIG. 2, the ferrule 102 contains a front slot 102*a* and a back slot 102*b*. The front and back slots 102*a* and 102*b* may partially or completely transverse the ferrule 102. In addition, the ferrule 102 contains a groove 102*d* located near the front slot 102*a* and a hole 102*c* that intersects the front slot 102*a* in a generally perpendicular arrangement. In some embodiments, the hole 102*c* may partially or completely transverse the ferrule 102. As shown in FIG. 1, the blades 104 are in a fixed blade configuration where a front portion of each blade 104 has been inserted into slot 102*a* and a rear portion of each blade 104 has been inserted into slot 102*b*.

Figure 3:
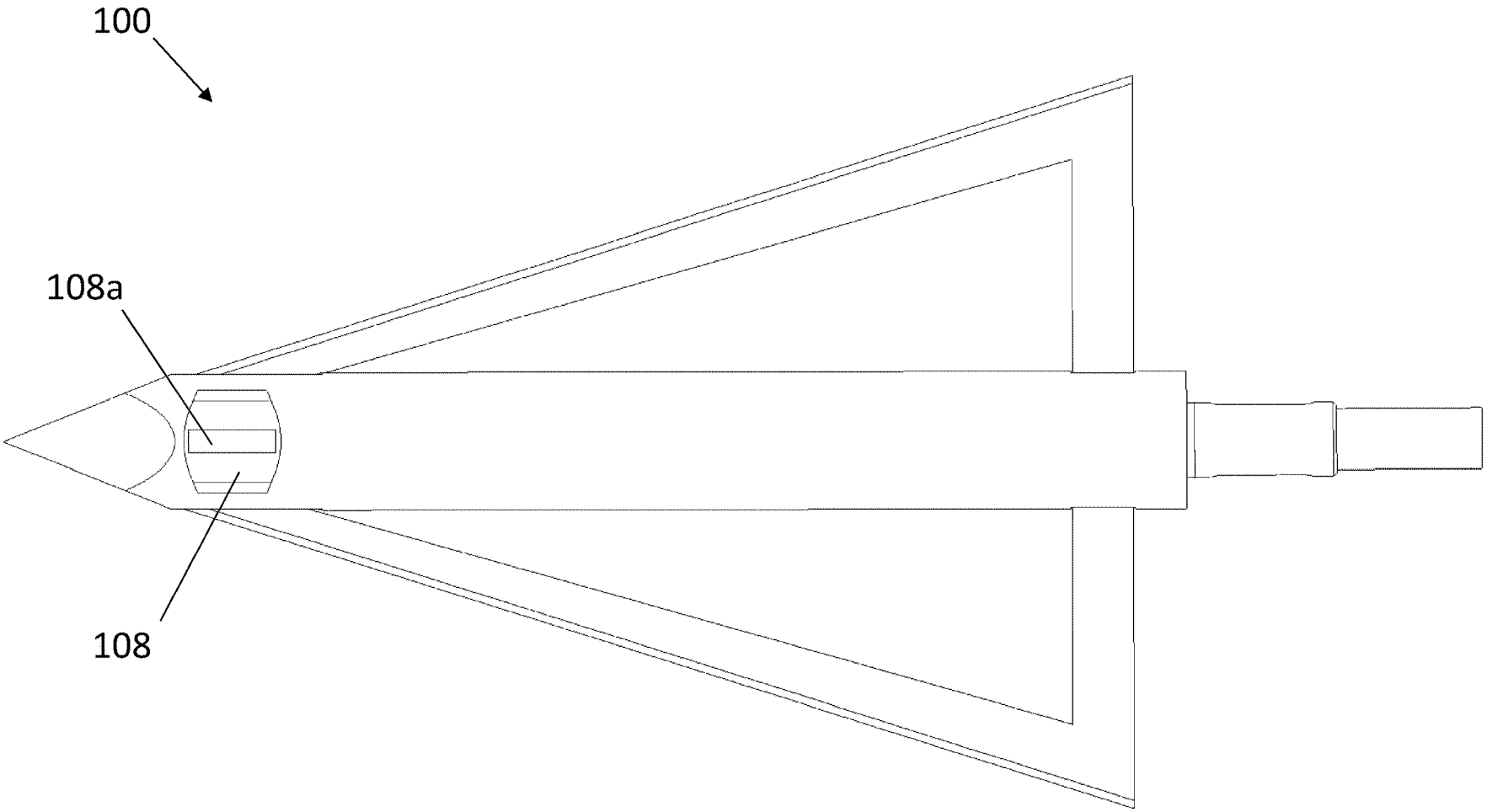
FIG. 3 is a bottom view of the embodiment of a fixed blade broadhead shown in FIG. 1.

Referring now to FIG. 3, a bottom view of the embodiment of broadhead 100 having fixed blades 104 is provided. In the embodiment shown, a pin 108 has been inserted into hole 102*c*. As explained in more detail below, pin 108 connects the fixed blades 104 to the ferrule 102 by pinning the blades 104 in line with hole 102*c*. In some embodiments, the pin 108 may have a curved pinhead such that, once the pin 108 is fully inserted into hole 102*c* in ferrule 102, it will be completely seeded within groove 103 and the curved pinhead will be flush with the curved surface of the ferrule 102, thus locking the pin 108 from coming out prematurely. In various embodiments, the pin 108 may include an indentation 108*a*, such as a slot, groove, cross, hex, or other shape, to facilitate twisting the pin 108 for tightening or loosening. In some embodiments, pin 108 may be threaded to screw into hole 102*c* or may be a push-pin, friction fit, quick release, or other configuration designed to removably secure the pin 108 within hole 102*c*.

Figure 4:
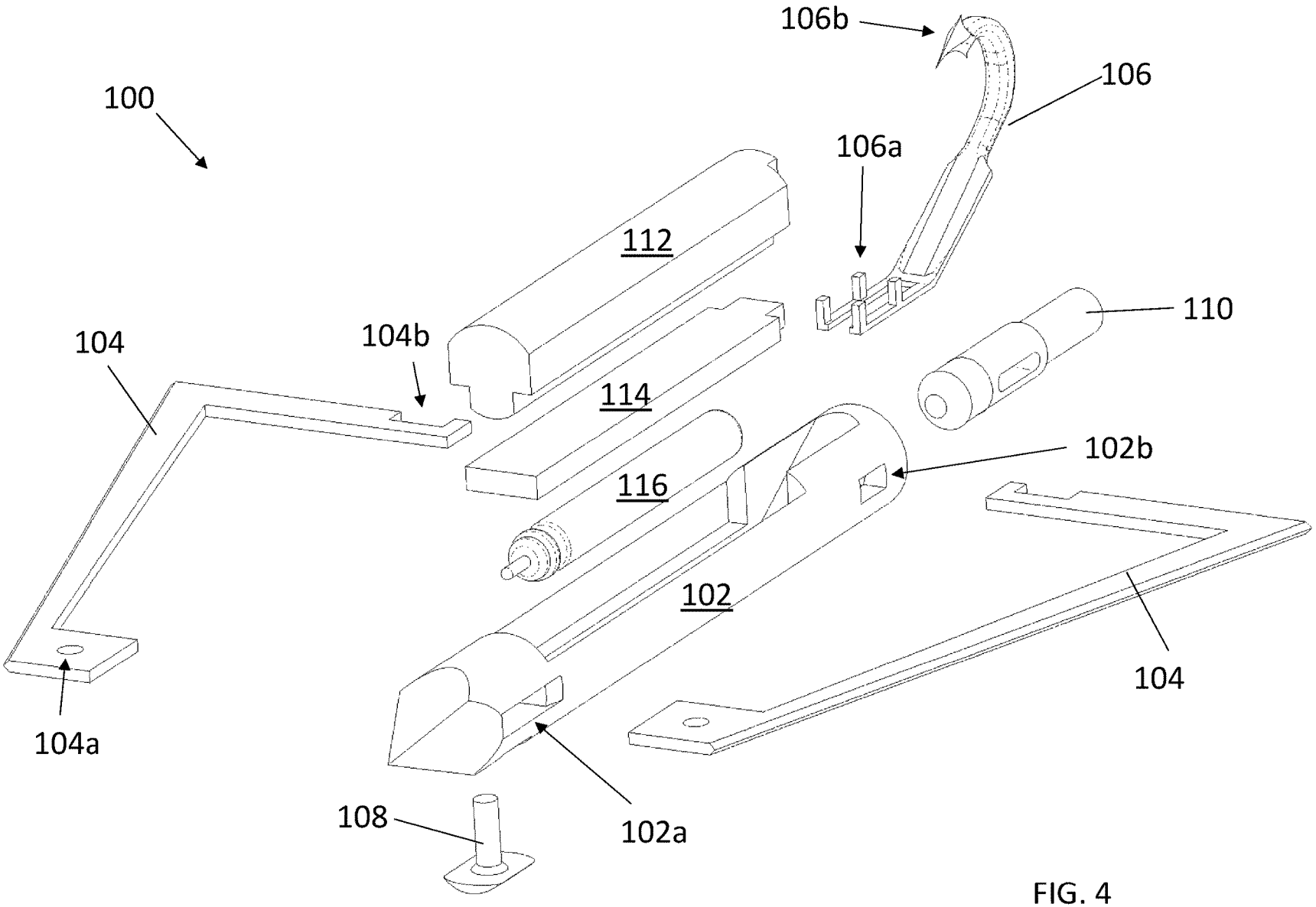
FIG. 4 is an exploded view of the embodiment of a fixed blade broadhead shown in FIG. 1.

Referring now to FIG. 4, an exploded view of an embodiment of broadhead 100 is shown. As can be seen, the broadhead 100 includes a ferrule 102, fixed blades 103, a barb 106, a pin 108, and a rear insert 110. In addition, in the embodiment shown, ferrule 102 has a recess in a mid-section thereof configured to receive a tracking device 114. In some embodiments, the tracking device 114 may be inserted into the ferrule 102 during manufacturing. In other embodiments, the ferrule 102 may include a removable cover 112 configured to provide access to the recess in the ferrule 102. In such embodiments, cover 112 can be removed and tracking device 114 can be inserted therein and then cover 112 can be resecured to the ferrule 102. In some embodiments, cover 112 may include a spacer inserted along with the tracking device 114 to prevent movement of the tracking device 114 within the recess or if no tracking device 114 is inserted. Tracking device 114 may include a battery 116 integral therewith or inserted along with the tracking device 114. In various embodiments, barb 106 may be permanently or removably attached to the tracking device 114. In some embodiments, barb 106 may include protrusions 106*a* to facilitate securing the tracking device 114 thereto. Barb 106 may be configured to be used in conjunction with a plurality of different transmitting devices 114, such as passive or active chips, tags, antennas, receivers, transmitters or other devices, that can be configured to fit within the recess inside the ferrule 102. The barb 106 may be designed such that a transmitting device 114 can fit within the ferrule 102 during manufacturing, for example, molding with plastic injection mold in the shape of the recess in the ferrule 102. Tabs 106*a* provide additional grip strength within the mold. Barb 106 may be configured to accept any tracking chip or device 114, regardless of what method or technology is used to track the animal. As can be seen in the FIG. 4, the barb 106 contains a hook portion 106*b* having a point and one or more barbs thereon for maximum penetration and retention once inside the animal's skin. Barb 106 may be reusable and, in some embodiments, may be made of non-toxic metal or other material. The barb 106 may also include an angled portion between the tabs 106*a* and the hook portion 106*b*. The angled portion may be formed at the same angle as a back surface of the recess in the ferrule 102. In some embodiments, the angle is approximately 30 degrees. The angled portion may allow for a smooth transition out of the ferrule 102 when the barb 106 penetrates the animal's hide. In various embodiments, the portion of the barb 106 having tabs 106 may be configured to sit flat against a bottom surface of the recess and fit snuggly against side walls of the recess. This allows the barb 106 to be held in place upon initial force recurring from the bow being shot while being loose enough to be removed upon impact with the animal. Barb 106 may have various attack angles of the slope or the shape of the barb, depending on the animal being hunted and other parameters.

Still referring to FIG. 4, as can be seen, the fixed blades 104 are sized and shaped to match the front and rear slots 102*a* and 102*b* of the ferrule 102. To secure the fixed blades 104, the front portion 104*a* of the fixed blades 104 is inserted into front slots 102*a* and a back portion 104*b* is inserted into back slots 102*b*. Pin 108 is then inserted into hole 102*c* and through the holes in the front portion 104*a* of the fixed blades 104. Insert 110 may then be inserted into the rear portion of the ferrule 102. In some embodiments, insert 110 may be threaded and configured to be screwed into the ferrule 102. In other embodiments, insert 110 may be pressed therein, may contain quick release detents, may be twist-locked in place, or other configuration for securement. The back portion 104*b* of the fixed blades 104 contains an indentation that aligns with the front surface of the insert 110 to secure the back portion 104*b* therein. In some embodiments, the insert 110 may be inserted before pin 108. Although generally triangular shaped fixed blades are shown, the fixed blades may be of any size, shape, and surface configuration. In addition, while pin 108 is shown to be removable, in some embodiments, pin 18 may be a push pin, button, detent, twist-to-lock, spring loaded, or other securement. In some embodiments, the broadhead 100 may include three or more fixed blades utilizing the same basic design of securing a front portion and back portion of the fixed blades. As can be seen in FIG. 4, the recess in a mid-section of the ferrule 102 allows a tracking device 114 to be inserted therein without interfering with the insertion of the replaceable blades 104.

Figure 5:
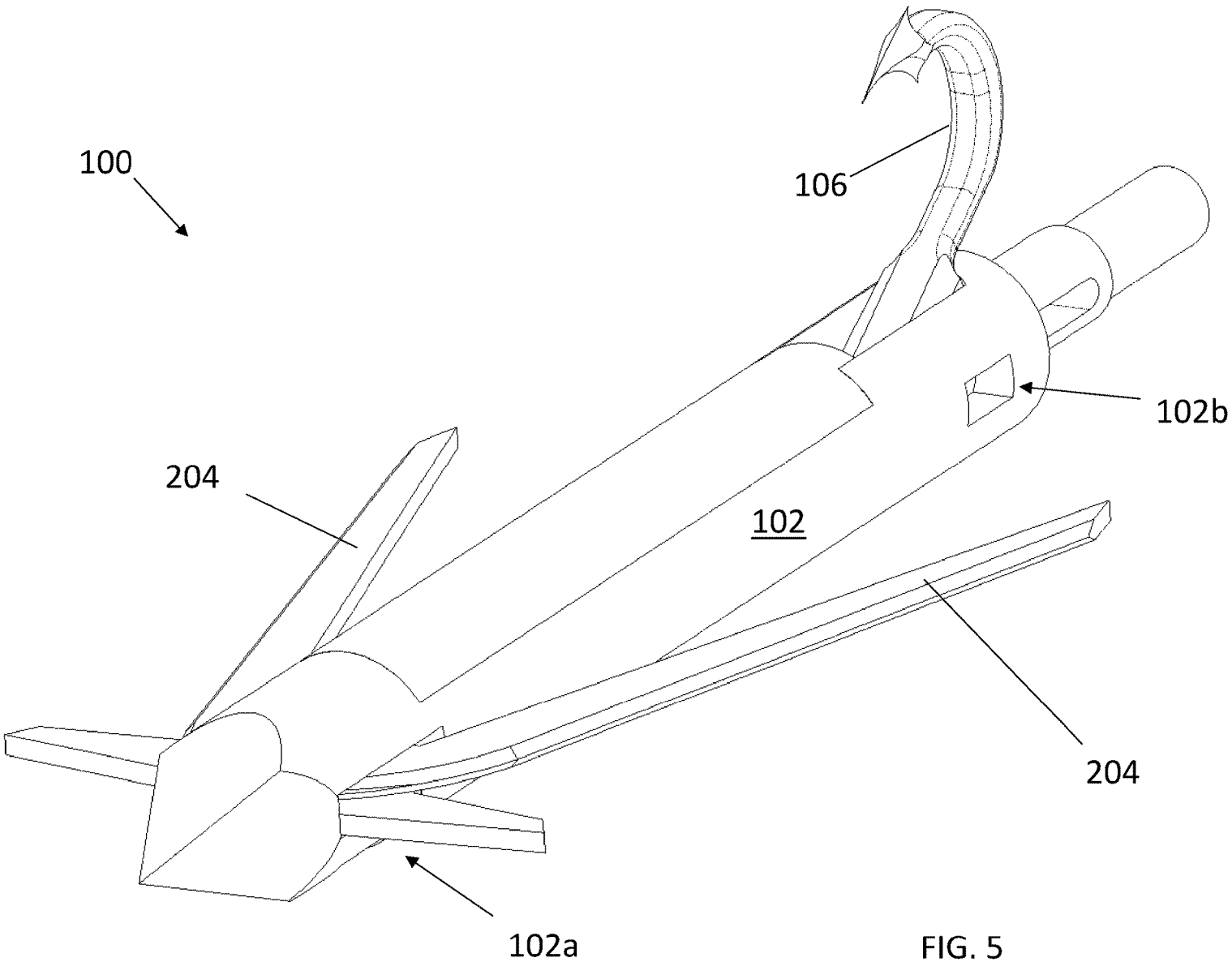
FIG. 5 illustrates a broadhead with expandable blades and a barb according to an embodiment.
Figure 6B:
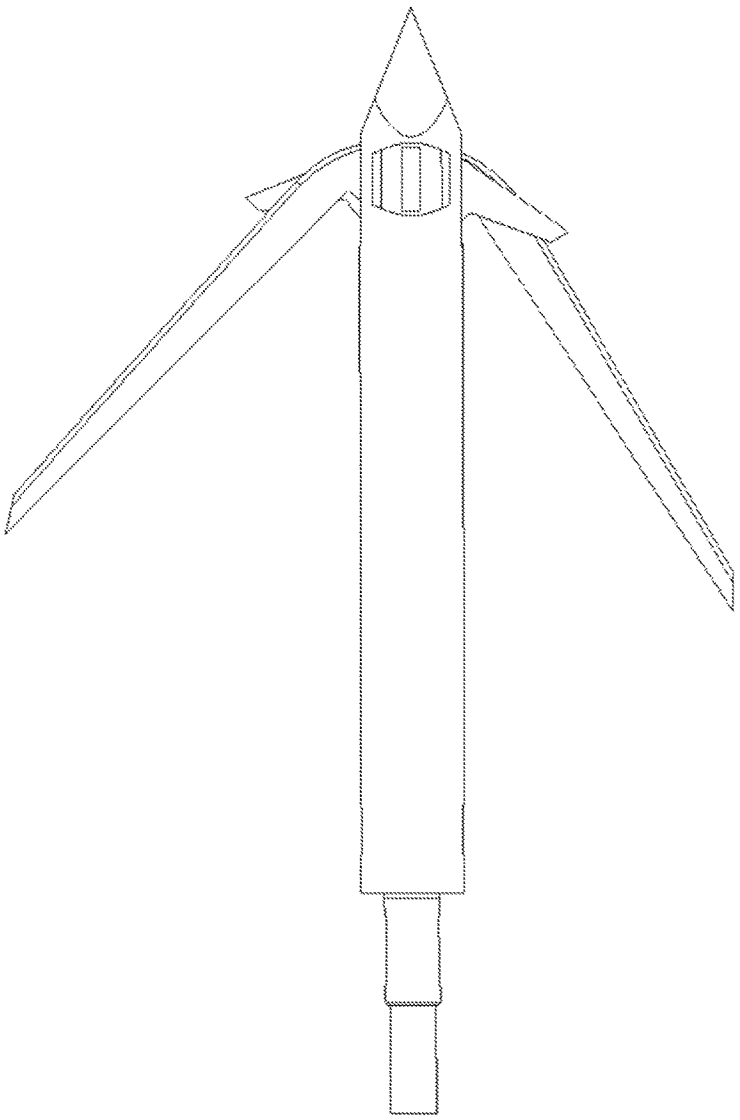
FIG. 6B is a bottom view of the embodiment shown in FIG. 5 with the blades in an expanded position.
Figure 6A:
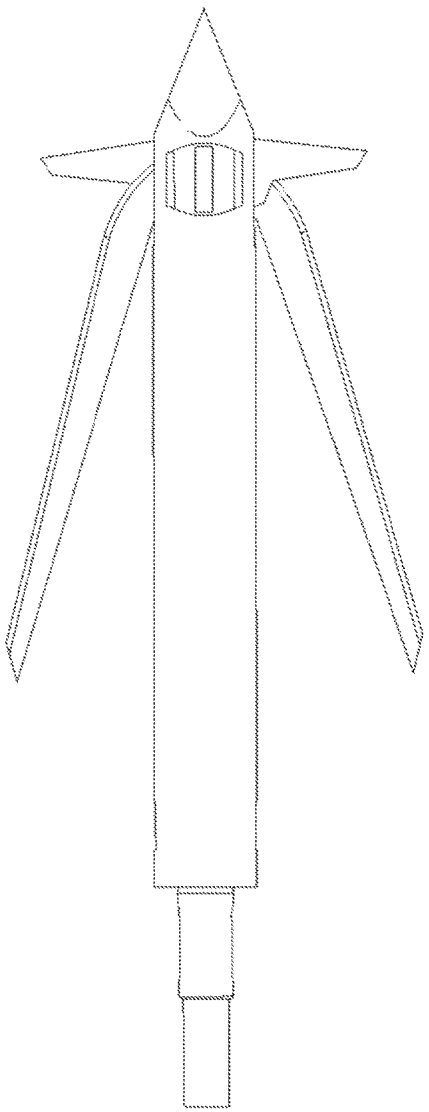
FIG. 6A is a bottom view of the broadhead shown in FIG. 5 with the blades in a retracted position.
Figure 7:
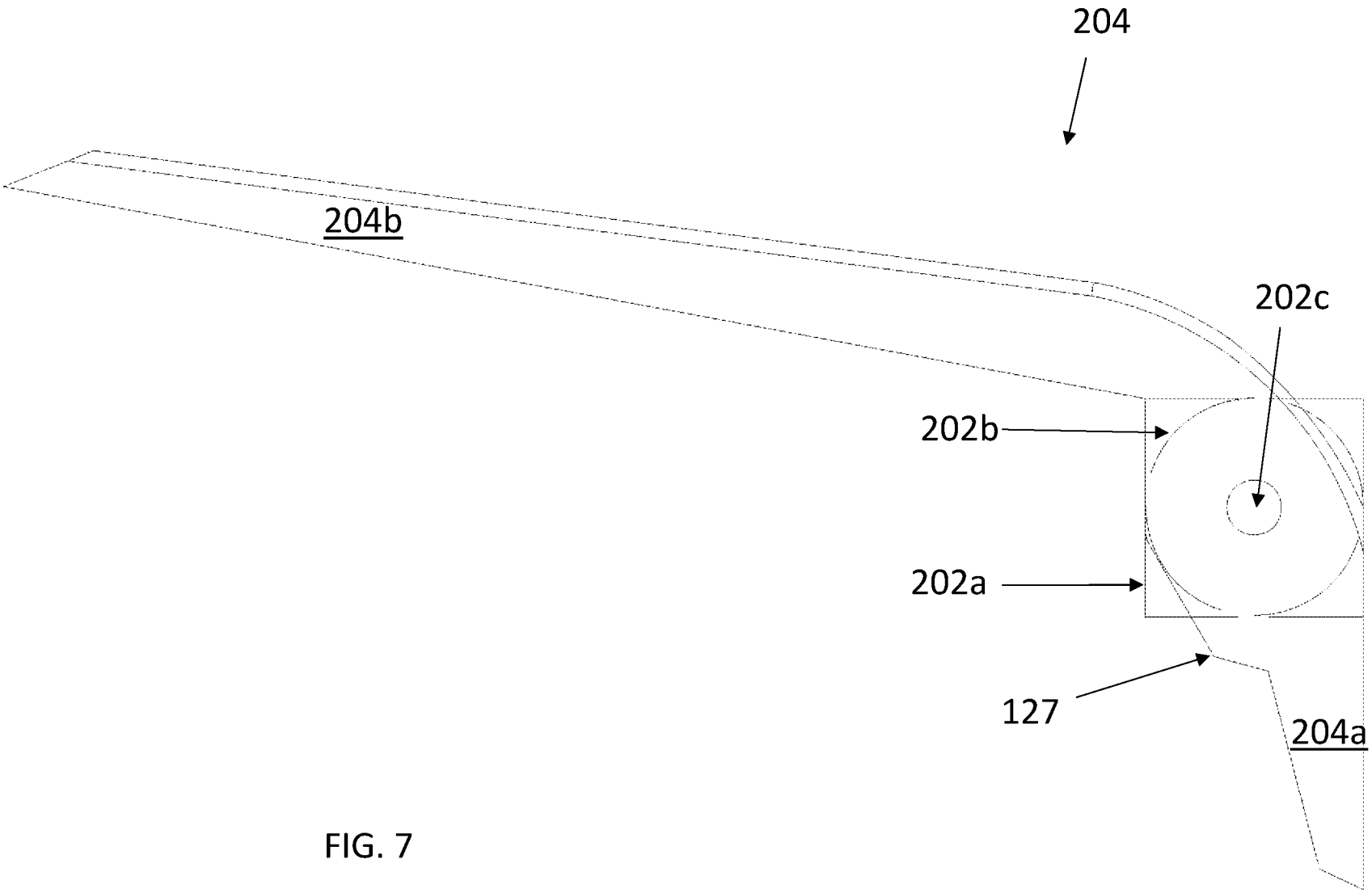
FIG. 7 is an embodiment of an expandable blade of the broadhead of FIG. 5.

Referring now to FIGS. 5-7, an embodiment of broadhead 100 is shown having expandable blades 204. In the embodiment shown, the broadhead 100 may utilize the same ferrule 102 and barb 106 as shown in FIG. 1. As shown in FIGS. 6A and 6B, the explainable blades 204 of broadhead 100 may be configured to rotate from a retracted position (shown in FIG. 6A) to an expanded position (shown in FIG. 6B). FIG. 7 shows an exemplary embodiment of an expandable blade 204. The square 202*a* represents the area of slot 102*a* in the ferrule 102 (shown in FIG. 2). Each expandable blade 204 has an impact portion 204*a* that receives an impact force upon contact with the target and also a cutting portion 204*b* that is exposed to the target when the blade is in the expanded position. Each expandable blade 204 is designed to move from the retracted position to the expanded position when the impact force travels through the blade. In some embodiments, the cutting portion 204*b* of each blade 204 is positioned or located opposite of the impact portion 204*a*, so that the cutting portion 204*b* is on one side and the impact portion 204*a* is on another side of the ferrule 102. Impact portion 204*a* of the blade 204 is the contact edge in which the force of the edge hitting the prey hide or skin forces the expandable blade 204 to pivot or rotate the cutting portion 204*b* outwardly from the ferrule 102.

As can be seen in FIG. 5, slots 102*b* in the ferrule 102 are not used when expandable blades 204 are inserted into slot 102*a*. In some embodiments, inserts (not shown) may be inserted into slots 102*b* to increase the aerodynamics of broadhead 100 and/or to keep blood and other material from filling slots 102*b*. In some embodiments, one or more fixed blades (not shown) may be inserted into slots 102*b*. In some embodiments, two or more blades may be inserted into each side of slots 102*a*. In such embodiments, each blade may have different design characteristics to increase damage. The two expandable blades 204 may be movably mounted within one slot 102*a* that transverses the ferrule 102. In other embodiments, three or more blades can be movably mounted to the ferrule 102. Blades 204 can be movably mounted to pivot, rotate, move along an arc, translate, move along a longitudinal direction and/or move in or along any other desired direction or movement path, by using elements taught herein or any other suitable elements that accomplish a similar movement. Impact portion 204*a* and cutting portion 204*b* of each blade 204 are positioned or located on or at opposite sides of slot 102*a*. A distance of moment arm can be increased or decreased to increase or decrease torque applied to blade 204 when the opening force or impact force is applied to impact portion 204*a*, such as through or along a blunt edge on a front portion of impact portion 204*a*. Also, the size and/or shape of impact portion 204*a* can be varied to differently apply a resultant impact force and thus differently move blade 204. In some embodiments, the front edge of impact portion 204*a* may be either blunt or sharp or have other surface configurations. In some embodiments, moment arm provides a mechanical advantage for transferring opening forces, such as impact force, from impact portion 204*a* through blade 204 to open and expose the sharp front edge of cutting portion 204*b* of blade 204 to the target material. In some embodiments, at least a portion of cutting portion 204*b* of blade 204 extends beyond the outer surface of ferrule 102 when broadhead 100 is in the retracted position. In other embodiments, cutting portion 204*b* may be completely contained within a slot, groove, or recess in ferrule 102 so that no portion of cutting portion 204*b* extends beyond the outer surface of ferrule 102 when broadhead 100 is in the retracted position.

As discussed above with respect to FIG. 6A and 6B, in some embodiments, broadhead 100 has a pivot pin 108 mounted within hole 102*c* of ferrule 102. Referring now to FIG. 7, blade 204 includes a hole 202*c* therein configured to align with hole 102*c*. In some embodiments, the size and shape of hole 202*c* and hole 102*c* as well as the size and shape of pivot pin 108 can be varied to accomplish different pivoting actions or other similar or different movements of blade 204 with respect to ferrule 102. For example, hole 202*c* can form a circle with a diameter that forms a relatively loose fit about pivot pin 108, or can have a diameter that forms a relatively tight fit about pivot pin 108, depending upon the frictional resistance and relative movement desired. For example, hole 202*c* and/or hole 102*c* can form a non-circle, such as a slot, that can be sized and shaped to result in more than just pivotal movement of blade 204, for example can result in pivotal and/or translational movement of blade 204 with respect to ferrule 102. In various embodiments, the blade 204 may be configured to rotate until a back edge of impact portion 204*a* abuts a surface of the ferrule 102 (such as a rear surface of slot 102*a*) and/or a front edge of cutting portion 204*b* abuts a surface of the ferrule 102 (such as a front surface of slot 102*a*). In some embodiments, the blade 204 may rotate on the order of 25 to 35 degrees or more that 35 degrees or less than 25 degrees. This configuration allows the blade 204 to swing open and closed around pin 108. Blade 204 may further comprise detent and/or raised portion or contact portion, which can be configured to contact an edge or surface of the ferrule 102. The size, dimensions and/or internal bias force of detent and/or raised portion can be varied to provide or supply a desired or a selected bias force acting upon blade. In other embodiments, detent and/or raised portion engages within bore or recess and/or another suitable opening within blade, to releasably hold blade in the retracted position. As shown in FIG. 7, the impact portion 204*a* includes a protrusion 127 slightly outside the radius of circle 202*b* thus providing additional friction to hold the blade 204 in the retracted position prior to impact and hold the blade in the expanded position after impact. In some embodiments, opening force or impact force applied to impact portion 204*a* transfers forces through blade 204, providing torque about the pivot pin 108, to move blade 204 from the retracted position to the expanded position. Features or parts of impact portion 204*a*, for example, including but not limited to the moment arm acting at or through blade 204, can be sized and designed to overcome the bias force of detent acting upon and holding or urging blade 204 in the retracted position. Thus, as broadhead 100 enters a target material, blade 204 can be designed to enter the target material with blade 204 in the retracted position and then upon contact between impact portion 204*a* and the target material, move blade 204 into the expanded position to extend a sharp edge of cutting portion 204*b* to cut the target material.

Figure 8:
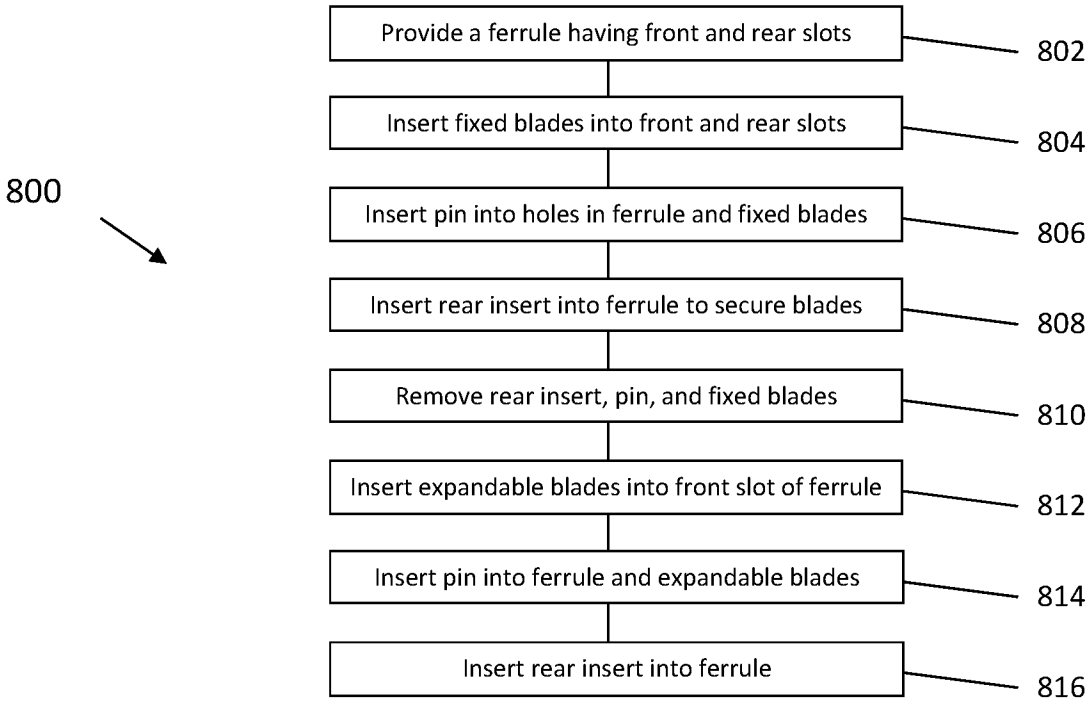
FIG. 8 is a flowchart of a method according to an exemplary embodiment.

Referring now to FIG. 8, a method of interchanging blades of a broadhead is provided. At step 802, a ferrule is provided having front and rear slots. At step 804, fixed blades are inserted into the front and rear slots. After fixed blades are inserted, pin 108 is inserted at step 806 into a hole in the ferrule perpendicular to front slots and holes in the fixed blades. Next, at step 808, rear insert is inserted into a rear portion of the ferrule to secure the rear portion of the blades. Next, to switch from fixed blades to expandable blades, the pin and rear insert are removed from the ferrule and the blades are pulled out of the front and rear slots at step 810. At step 812, expandable blades are inserted into the front slot of the ferrule. Next, at step 814, the pin is inserted into the hole in the ferrule and the holes in the expandable blades and the rear insert is inserted into the ferrule at step 816. In some embodiments, the rear slots of the ferrule may be configured in a similar manner as the front slots such that a transverse pin may be inserted to secure both the front and rear portions of the fixed blades without the need to insert the rear insert into the ferrule. In other embodiments, the rear portion of the fixed blades may include a notch configured to matingly engage a back edge of the rear slot without the need to insert the rear insert into the ferrule.

Although various embodiments of the method and apparatus of the present invention have been illustrated in the accompanying Drawings and described in the foregoing Detailed Description, it will be understood that the invention is not limited to the embodiments disclosed, but is capable of numerous rearrangements, modifications, and substitutions without departing from the spirit and scope of the invention.

What is claimed is:

1. A hunting arrowhead comprising:

a ferrule having a nose at a front end and a threaded portion at a back end configured to receive an arrow shaft a recess in the ferrule between the nose and the threaded portion, the recess having a front surface, a sloped back surface, and side walls disposed between the front surface and the sloped back surface;

a tracking device comprising:

a cover molded in the shape of the recess in the ferrule;

a transmitting device within the cover and configured to communicate with an external device to aide in locating the tracking device; and a barb having a first end coupled to the transmitting device, a second end having a hook portion with a point, and a middle portion between the first end and the second end;

a set of blades secured to the ferrule at a forward location along an axis of the ferrule between the nose and the front surface of the recess; and the tracking device being configured to be removably inserted into the recess such that the middle portion of the barb abuts the sloped back surface of the recess.

2. The hunting arrowhead of claim 1 and further comprising:

wherein the set of blades are expandable blades having an impact portion at one end thereof, a cutting portion at an opposite end thereof, and a hole between the impact portion and the cutting portion, wherein the expandable blades are configured to be inserted through a first slot at the forward location such that the holes of the expandable blades align with an aperture of the ferrule.

3. The hunting arrowhead of claim 1 and further comprising:

wherein the set of blades are secured to the ferrule at a rearward location along the axis of the ferrule between the threaded portion and the recess.

4. The hunting arrowhead of claim 3 and further comprising:

wherein the set of blades are fixed blades having a first end and a second end, the first end being configured to be inserted into a first slot at the forward location and the second end being configured to be inserted into a second slot at the rearward location, wherein the first end has a hole therethrough configured to align with an aperture of the ferrule when the first end is inserted into the first slot.

5. The hunting arrowhead of claim 1, wherein the threaded portion comprises a rear insert configured to be removably inserted into an opening in the back end of the ferrule.

6. The hunting arrowhead of claim 1, wherein the first end of the barb contains tabs to provide additional grip strength within the cover.

7. The hunting arrowhead of claim 1, wherein the tracking device is configured so that when the ferrule penetrates a target, the hook portion of the barb is retained in an outer surface of the target to dislodge the tracking device from the ferrule after the transmitting device has penetrated the target.

8. The hunting arrowhead of claim 1, wherein the ferrule is generally cylindrical and the cover has a curved outer surface that generally aligns with the cylindrical surface of the ferrule when the tracking device is inserted into the recess.

9. A hunting arrowhead system for hunting an organism comprising:

a ferrule for penetrating an organism, the ferrule comprising a longitudinal axis having a threaded portion configured to be attached to an arrow shaft at one end thereof, a nose at an opposite end thereof, and a recess between the nose and the threaded portion, the recess having a front surface, a sloped back surface, and side walls disposed between the front surface and the sloped back surface;

a removable insert molded in the shape of the recess and configured to at least partially fill the recess, the removable insert having a tracking device therein configured to communicate with an external device;

a barb having a first end configured to be coupled to the tracking device, a second end having a hook portion with a point configured to extend out from a surface of the ferrule when the removable insert is inserted into the recess of the ferrule, and a middle portion between the first end and the second end, the middle portion and the first end forming a non-linear angle; and a set of replaceable blades configured to be secured to the ferrule at a forward location along an axis of the ferrule between the nose and the front surface of the recess.

10. The hunting arrowhead system of claim 9 and further comprising:

wherein the set of replaceable blades are expandable blades having an impact portion at one end thereof, a cutting portion at an opposite end thereof, and a portion disposed between the impact portion and the cutting portion, wherein when the expandable blades are inserted into the forward location, each expandable blade can be movably secured therein.

11. The hunting arrowhead system of claim 9 and further comprising:

wherein the set of replaceable blades are configured to be secured to the ferrule at a rearward location along the axis of the ferrule between the threaded portion and the recess.

12. The hunting arrowhead system of claim 11 and further comprising:

wherein the set of replaceable blades are fixed blades having a front end with a hole therethrough and a tail end spaced apart from the front end such that, when the front end is inserted into the forward location, the tail end can be inserted into the rearward location and secured therein.

13. The hunting arrowhead system of claim 9, wherein the threaded portion of the ferrule is removably attached to the ferrule.

14. The hunting arrowhead system of claim 9, wherein the tracking device is configured so that when the ferrule penetrates a target, the hook portion of the barb is retained in an outer surface of the target to dislodge the removable insert from the ferrule after the tracking device has penetrated the target.

15. A method of providing a tracking device in a hunting arrowhead comprising:

providing a ferrule having a nose at one end, a threaded portion at an opposite end, a recess between the nose and the threaded portion defined by inner surfaces of the ferrule;

providing a tracking device configured to be removably inserted into the recess, the tracking device being configured to communicate with an external device;

providing a removable barb configured to be partially disposed in the recess, the barb having a first end configured to be coupled to the tracking device, a second end extending out from a surface of the ferrule, and a middle portion between the first end and the second end, the middle portion and the first end forming a non-linear angle;

providing a removable cover configured to at least partially enclose the recess;

in a first mode of operation, securing the removable barb to the tracking device, inserting the tracking device and at least a portion of the removable barb into the recess, and securing the removable cover over the tracking device; and in a second mode of operation, inserting a space filler in the recess and securing the cover over the space filler.

* * * * *